US006568727B2

(12) United States Patent
Adelmeyer

(10) Patent No.: US 6,568,727 B2
(45) Date of Patent: May 27, 2003

(54) RETENTION AND REINFORCEMENT SYSTEM FOR KNOBS AND LEVERS

(75) Inventor: Gerard G. Adelmeyer, Monarch Beach, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/777,117

(22) Filed: Feb. 5, 2001

(65) Prior Publication Data

US 2002/0105195 A1 Aug. 8, 2002

(51) Int. Cl.[7] ..... E05B 3/02

(52) U.S. Cl. ..... 292/348; 292/336.3; 292/347; 292/358; 292/DIG. 53; 70/417; 70/449

(58) Field of Search ..... 292/347, 348, 292/349, 350, 351, 352, 353, 354, 355, DIG. 53, 336.3, 356, 358; 70/417, 224, 449, 215–217

(56) References Cited

U.S. PATENT DOCUMENTS

| | | | | |
|---|---|---|---|---|
| 1,853,782 | A | | 4/1932 | Schlage |
| 1,992,126 | A | | 2/1935 | Hurd |
| 3,075,796 | A | | 1/1963 | Russell et al. |
| 3,955,387 | A | | 5/1976 | Best et al. |
| 3,985,008 | A | | 10/1976 | Hart |
| 4,109,498 | A | | 8/1978 | Dietrich |
| 4,338,804 | A | | 7/1982 | Solovieff |
| 4,424,691 | A | | 1/1984 | Foshee |
| 4,995,249 | A | | 2/1991 | Preissler et al. |
| 5,219,193 | A | * | 6/1993 | Piltingsrud ..... 292/240 |
| 5,265,924 | A | | 11/1993 | Kim |
| 5,286,074 | A | | 2/1994 | Lin |
| 5,291,767 | A | | 3/1994 | Weindorf, Jr. et al. |
| 5,316,353 | A | | 5/1994 | McKernan |
| 5,322,333 | A | | 6/1994 | Norton, II et al. |
| 5,335,948 | A | | 8/1994 | Norton, II et al. |
| 5,335,950 | A | | 8/1994 | Mirshafiee et al. |
| 5,385,374 | A | | 1/1995 | Fann et al. |
| 5,481,890 | A | | 1/1996 | Millman |
| 5,666,833 | A | | 9/1997 | Gao et al. |
| 5,735,556 | A | | 4/1998 | Chan |
| 5,749,612 | A | * | 5/1998 | Meck et al. ..... 292/347 |
| 5,782,119 | A | | 7/1998 | Ellis et al. |

* cited by examiner

*Primary Examiner*—J. J. Swann
*Assistant Examiner*—Thomas Ho
(74) *Attorney, Agent, or Firm*—Richard J. Veltman; John D. Del Ponti

(57) ABSTRACT

A collar coacts with a chassis, sleeve and lever of a lockset to provide a retention and reinforcement system for lock assemblies. The collar has a flanged portion and a sleeve-engaging portion and is sandwiched between a lever and the cylinder. The sleeve-engaging portion includes at least one tab that engages the sleeve to retain the collar on the sleeve. Alternatively, the collar can be staked to the sleeve. A spring washer can be mounted between the collar and the chassis to take up variation in manufacturing tolerances. The result is a retention and reinforcement system that provides a protection against attack in the zone of attack around the handle-chassis interface.

13 Claims, 4 Drawing Sheets

RETENTION AND REINFORCEMENT SYSTEM FOR KNOBS AND LEVERS

FIELD OF THE INVENTION

The invention relates to guards for protecting a zone between a lever, knob or the like and a chassis of a lock assembly, and to the lock assembly itself.

BACKGROUND OF THE INVENTION

A sleeve in a lockset is most vulnerable at the zone where the knob or lever adjoins the hub, especially for those chassis cover appearance designs that do not provide overlap reinforcement. Accordingly, reinforcement and axial retention of a knob or lever sleeve to its chassis at the vulnerable zone is highly desirable. It is also desirable to provide for cost-efficient sleeve manufacturing options, and for additional chassis styling options for knobs and levers that are subject to forced-entry attack.

SUMMARY OF THE INVENTION

The present invention provides a retention and reinforcement system for knobs, levers and the like. It also provides a lock assembly including a retention and reinforcement system for knobs, levers and the like. Use of a rigid, cylindrical support collar in combination with the knob or lever and the chassis achieves at least the following advantages:

1. axial retention of the sleeve to the hub;
2. improved resistance to axial wobble; operating stability is enhanced by the axial length of the support collar;
3. radial reinforcement of the sleeve to withstand sleeve distortion during forced entry attacks; and
4. the axial length of the collar is sufficient to allow the knob or lever itself to provide positive axial retention of the collar to the sleeve.

According to the present invention, a retention and reinforcement system for knobs, levers and the like, comprises a chassis defining an aperture, a sleeve extending from the chassis aperture, a collar, and a graspable member. The graspable member includes a sleeve-engaging portion defining an interior wall. The collar includes a flanged portion and a sleeve engaging portion and is sandwiched between the sleeve and the interior wall of the graspable member with the flanged portion disposed adjacent the chassis and the sleeve engaging portion disposed adjacent the sleeve.

The flanged portion defines a flange extending radially outwardly a predetermined distance from the sleeve-engaging portion and the sleeve-engaging portion defines a sleeve-engaging member coupled to the sleeve. According to one aspect of the invention, the sleeve-engaging member includes at least one tab that engages an aperture in the sleeve to retain the collar on the sleeve. According to another aspect of the invention, the sleeve-engaging member includes an aperture having an edge that is staked to the sleeve. The sleeve-engaging member can further include a dimple engaging an aperture formed in the sleeve.

BRIEF DESCRIPTION OF THE DRAWINGS

In the accompanying drawings, in which like reference characters in the same or different Figures, indicate like parts.

DETAILED DESCRIPTION OF THE PREFERRED EMBODIMENTS

Figures 1, 1B:
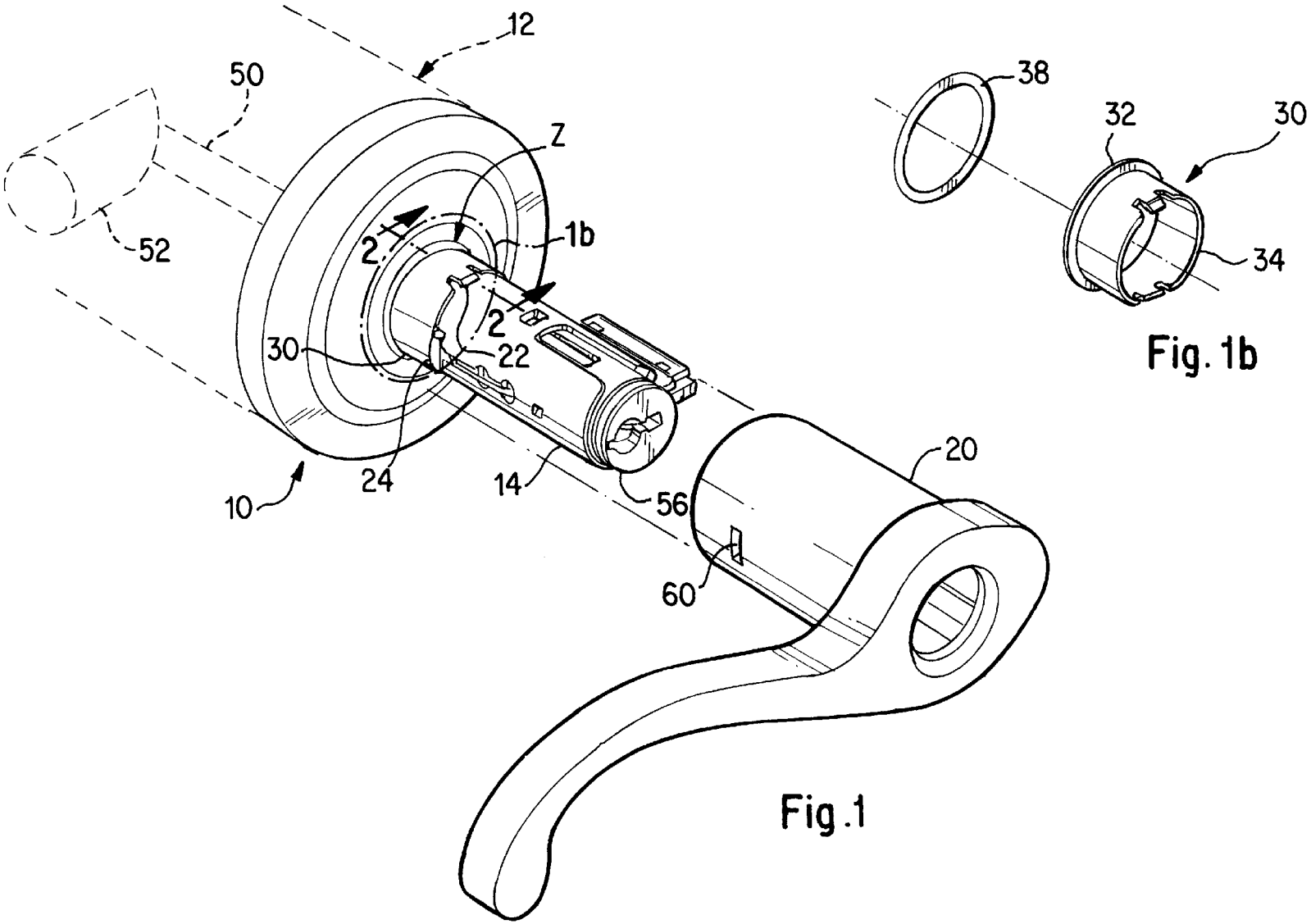
FIG. 1 is a perspective schematic exploded view of the retention and reinforcement system of the present invention, in use with a lever.
FIG. 1*b* is a perspective schematic exploded view of a collar and spring washer for use with the present invention.
Figure 2:
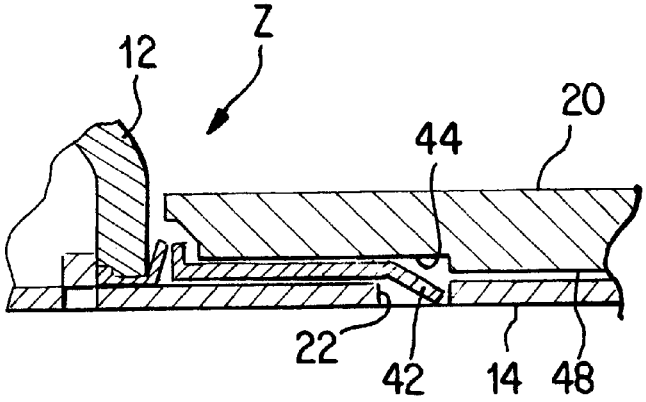
FIG. 2 is a cross-sectional view taken along line 2—2 in FIG. 1 with a rose and lever added.
Figure 3:
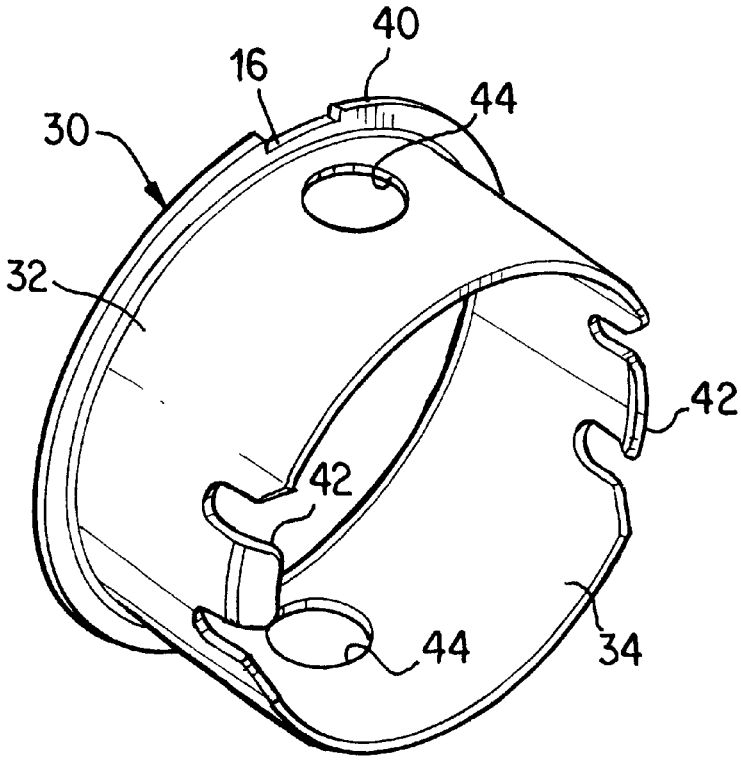
FIG. 3 is a perspective view of the collar of the present invention.

FIGS. 1–3 illustrate one embodiment of the retention and reinforcement system of the present invention which is provided primarily to protect against attach upon the lock assembly directed to the zone Z where a graspable member such as a lever or knob is adjacent to the chassis.

As illustrated, a lock assembly 10 includes a chassis 12 and a sleeve 14 protruding from the chassis 12, with a lever 20 or knob mounted on the sleeve 14. The sleeve 14 includes a pair of diametrically opposed tab-receiving apertures 22 and a biased retaining member 24 that engages the lever 20 and axially retains it on the sleeve 14. A cylindrical collar 30 with a proximal end 32 and a distal end 34 is disposed on the sleeve 14 with the proximal end 32 adjacent the chassis 12. A standard, readily-available spring washer 38 is mounted on the sleeve 14 between the chassis 12 and the proximal end 32 of the collar 30 to take up excess axial clearance with the chassis 12 which may be caused by variations in manufacturing tolerances. The retaining member 24 is disposed adjacent the distal end 34 of the collar 30.

As shown schematically and in dashed lines, the sleeve 14 is operatively associated in a conventional manner with a latch actuator 50, which in turn is operatively associated with a latch mechanism 52 to move a latch bolt (not shown). A key cylinder 56 is mounted in the sleeve 14 and the lever 20, such that the retaining member 24 engages a slot 60 in the lever 20.

As shown more clearly in FIG. 3, the collar 30 includes a flange 40 extending radially outwardly from the proximal end 32. If desired, notches 16 may be formed in the flange 40 to facilitate automated manufacturing. Alternatively, the flange 40 may be segmented, as illustrated by the dashed lines of FIG. 3. The collar 30 further includes a pair of radially inwardly bent tabs 42 disposed at the distal end 34 and a pair of diametrically opposed apertures 44 offset 90° from the tabs 42. Preferably, the collar 30 is formed from a single piece of metal.

The collar 30 is located on the sleeve 14 with the tabs 42 engaging their respective tab-receiving apertures 22, as shown in FIGS. 1 and 2. The interior wall 48 of lever 20 restrains the tabs 42 from disengaging from the tab-receiving apertures 22. Furthermore, the proximity of the retaining member 24 and a counterbore 44 in the interior wall 48 of the knob or lever 20 provides additional axial reinforcement of the collar 30 itself, as shown in FIG. 2.

Referring now to FIG. 3, the collar of the present invention is illustrated in two embodiments. Access apertures 44 are formed which, when the collar is mounted upon the sleeve 14, provide access for a punching operation that rigidly couples the sleeve 14 to a locking mechanism (not shown).

Figure 4:
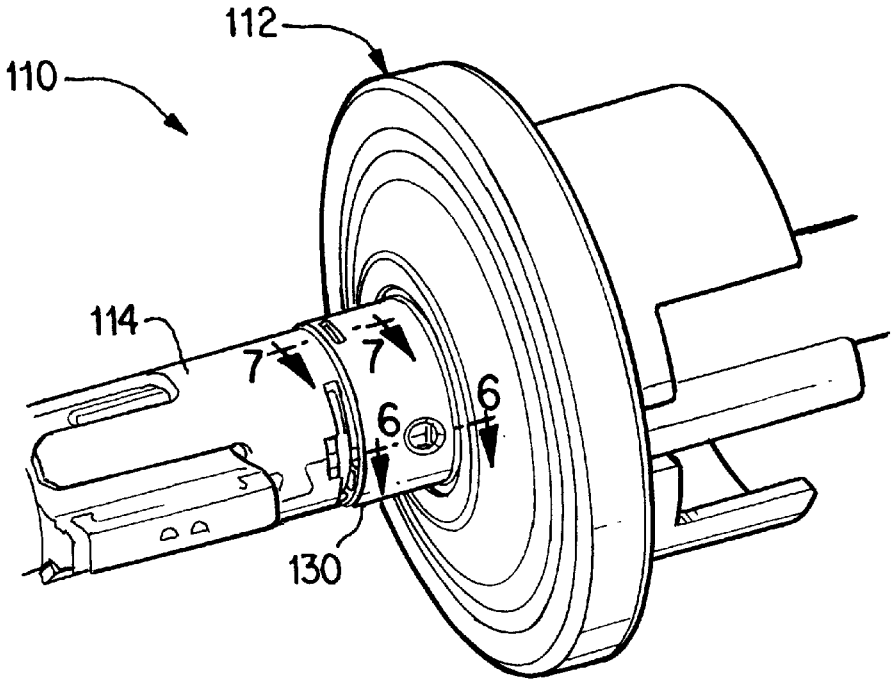
FIG. 4 is a perspective view of an alternative embodiment of the retention and reinforcement system.
Figure 5:
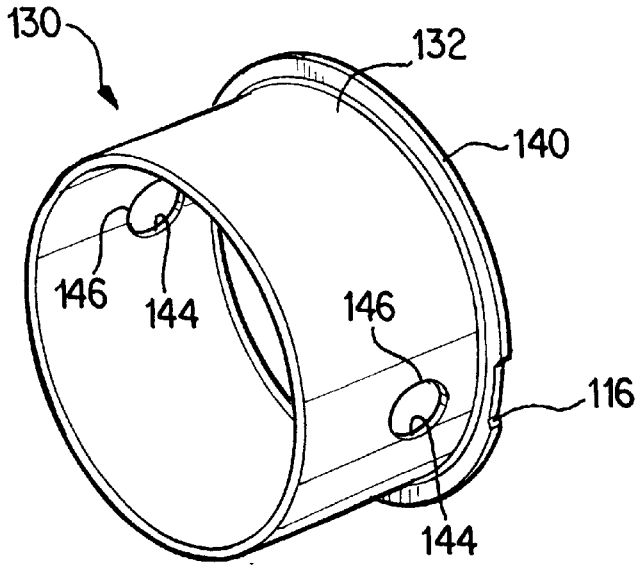
FIG. 5 is a perspective view of a support collar for use with the embodiment of FIG. 4.
Figure 6:
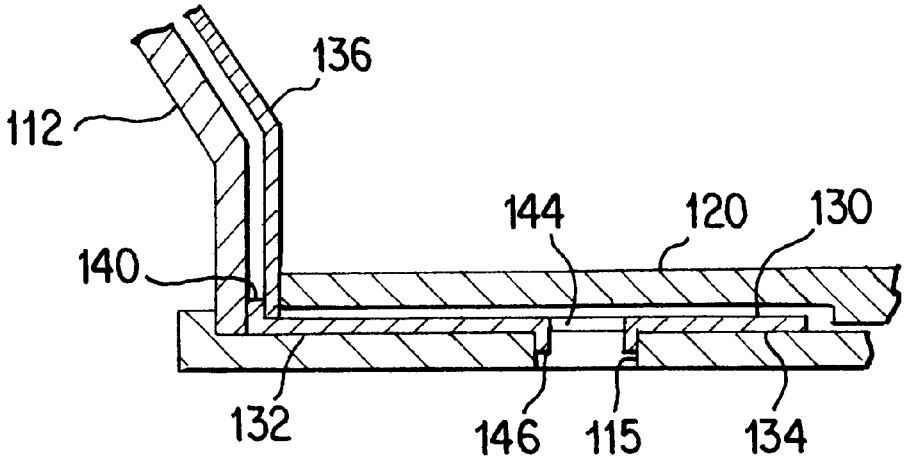
FIG. 6 is a cross-sectional view taken along line 6—6 in FIG. 4.

Referring to FIGS. 4–6, a lock assembly 110 includes a chassis 112 and a sleeve 114, with a lever 120 (FIG. 6) or knob mounted on the sleeve 114. The sleeve 114 includes a pair of diametrically opposed apertures 122. A cylindrical collar 130 with a proximal end 132 and a distal end 134 is disposed on the sleeve 114 with the proximal end 132 adjacent the chassis 112.

As shown more clearly in FIG. 5, the collar 130 includes a flange 140 extending radially outwardly from the proximal end 132. A decorative cover 136 (FIG. 6), disposed between the chassis 112 and the lever 120 (FIG. 6), covers the flange 140 to protect it from direct attack. If desired, notches 116 may be formed in the flange 140 to facilitate automated manufacturing. Alternatively, the flange 140 may be segmented. The collar 130 further includes a pair of diametrically opposed apertures 144 having edges 146. Preferably, the collar 130 is formed from a single piece of metal.

The collar 130 is located on the sleeve 114 with the apertures 144 aligned with clearance apertures 115 formed in the sleeve 114. Preferably, the diameter of the apertures 144 is less than the diameter of the clearance apertures. During manufacture, the clearance holes 115 provide access for a punching operation that rigidly couples the sleeve 114 to a locking mechanism (not shown). After the punching operation, a staking operation forces the edges 146 of the apertures 144 into the clearance apertures 115 to help secure the collar 130 to the sleeve 114, as illustrated in FIG. 6.

Figure 7:
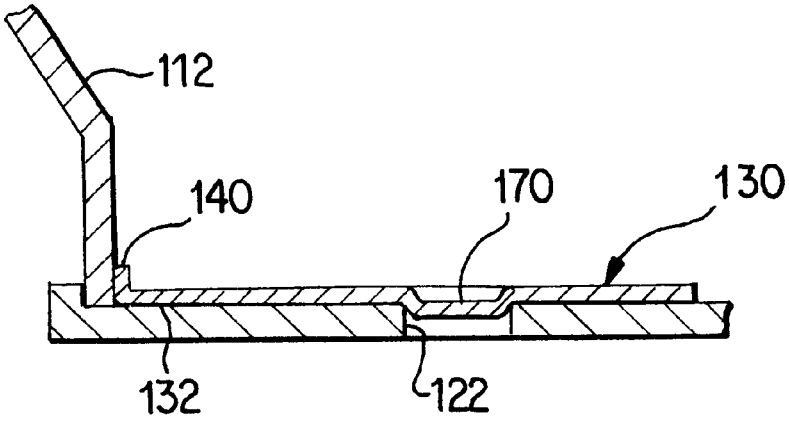
FIG. 7 is a cross-sectional view taken along line 7—7 in FIG. 4.

The collar 130 is also staked to the sleeve 114 at the apertures 122, as illustrated in FIG. 7. The staking operation forms dimples 170 in the collar 130 that engage the apertures 122 to provide additional strength and support.

The above-described embodiments, of course, are not to be construed as limiting the breadth of the present invention. Modifications and other alternative constructions will be apparent which are within the spirit and scope of the invention as defined in the appended claims.

What is claimed is:

1. A retention and reinforcement system for knobs or levers, comprising:

a chassis defining an aperture;

a sleeve extending from the chassis aperture;

a graspable member having an interior wall and being configured to engage the sleeve and having an axially-inner end;

a collar having a flanged portion and a sleeve engaging portion;

the collar being sandwiched between the sleeve and the interior wall of the graspable member with the flanged portion disposed adjacent the chassis and the sleeve engaging portion disposed adjacent the sleeve, the sleeve-engaging portion defining a sleeve-engaging member coupled to the sleeve, the sleeve-engaging member being directed generally radially inwardly of the collar and into a receptacle formed in the sleeve, the flange and the sleeve-engaging member coacting to axially retain the collar on the sleeve.

2. A retention and reinforcement system for knobs or levers comprising:

a chassis defining an aperture;

a sleeve extending from the chassis aperture;

a graspable member having an interior wall and being configured to engage the sleeve and having an axially-inner end;

a collar having a flanged portion and a sleeve engaging portion;

the collar being sandwiched between the sleeve and the interior wall of the graspable member with the flanged portion disposed adjacent the chassis and the sleeve engaging portion disposed adjacent the sleeve, the sleeve-engaging portion defining a sleeve-engaging member coupled to the sleeve, the sleeve-engaging member including an edge, the edge being staked into the sleeve.

3. A retention and reinforcement system for knobs or levers comprising:

a chassis defining an aperture;

a sleeve extending from the chassis aperture;

a graspable member having an interior wall and being configured to engage the sleeve and having an axially-inner end;

a collar having a flanged portion and a sleeve engaging portion;

the collar being sandwiched between the sleeve and the interior wall of the graspable member with the flanged portion disposed adjacent the chassis and the sleeve engaging portion disposed adjacent the sleeve, wherein the collar defines a cylindrical wall having an end, the wall includes at least one tab adjacent the end and extending radially inwardly a predetermined distance, and the at least one tab engages a sleeve receptacle.

4. The system of claim 3 wherein the collar is formed of a single piece of metal, the at least one tab including a portion bent radially inwardly, the sleeve receptacle including a through-hole formed in the sleeve outer wall, and the bent portion lying within the sleeve through-hole.

5. A retention and reinforcement system for knobs or levers comprising:

a chassis defining an aperture;

a sleeve extending from the chassis aperture;

a graspable member having an interior wall and being configured to engage the sleeve and having an axially-inner end;

a collar having a flanged portion and a sleeve engaging portion;

the collar being sandwiched between the sleeve and the interior wall of the graspable member with the flanged portion disposed adjacent the chassis and the sleeve engaging portion disposed adjacent the sleeve, wherein the flanged portion defines a flange extending radially outwardly a predetermined distance from the sleeve-engaging portion and the collar defines a cylindrical wall and the flanged portion defines a plurality of flanges extending radially-outwardly from the wall adjacent one axially-inner end of the collar.

6. A retention and reinforcement system for knobs or levers comprising:

a chassis defining an aperture;

a sleeve extending from the chassis aperture and including a retaining member operatively associated with a graspable member;

the graspable member having an interior wall and being configured to engage the sleeve and having an axially-inner end;

a collar having a flanged portion, a sleeve engaging portion, an axially-outer end and defining two access apertures formed in the collar cylinder wall, the access apertures being located such that at least one of them is adjacent the retaining member, the retaining member extending radially outwardly from the sleeve adjacent an axially-outer end of the collar;

the collar being sandwiched between the sleeve and the interior wall of the graspable member with the flanged portion disposed adjacent the chassis and the sleeve engaging portion disposed adjacent the sleeve.

7. A retention and reinforcement system for knobs or levers comprising:

a chassis defining an aperture;

a sleeve extending from the chassis aperture;

a graspable member having an interior wall and being configured to engage the sleeve and having an axially-inner end;

a collar having a flanged portion and a sleeve engaging portion; and a biasing member between the chassis and the collar, the collar being sandwiched between the sleeve and the interior wall of the graspable member with the flanged portion disposed adjacent the chassis and the sleeve engaging portion disposed adjacent the sleeve.

8. The system of claim 7 wherein the biasing member is mounted on the sleeve.

9. The system of claim 7 wherein the biasing member is a spring washer mounted over the sleeve and adjacent the chassis, the collar being mounted on the sleeve such that the spring washer is compressed between the collar and the chassis.

10. A retention and reinforcement system for knobs or levers comprising:

a chassis defining an aperture;

a sleeve extending from the chassis aperture and including a retaining member operatively associated with a graspable member;

the graspable member having an interior wall and being configured to engage the sleeve and having an axially-inner end, the graspable member being a lever defining a slot into which the retaining member protrudes to retain the lever on the sleeve;

a collar having a flanged portion, a sleeve engaging portion, an axially-outer end and defining two access apertures formed in the collar cylinder wall, the access apertures being located such that at least one of them is adjacent the retaining member, the retaining member extending radially outwardly from the sleeve adjacent an axially-outer end of the collar;

the collar being sandwiched between the sleeve and the interior wall of the graspable member with the flanged portion disposed adjacent the chassis and the sleeve engaging portion disposed adjacent the sleeve.

11. A retention and reinforcement system for knobs or levers comprising:

a chassis defining an aperture;

a sleeve extending from the chassis aperture;

a graspable member having an interior wall and being configured to engage the sleeve and having an axially-inner end;

a collar having a flanged portion and a sleeve engaging portion including an edge defining a collar aperture, the edge being staked to the sleeve;

the collar being sandwiched between the sleeve and the interior wall of the graspable member with the flanged portion disposed adjacent the chassis and the sleeve engaging portion disposed adjacent the sleeve.

12. The system of claim 11 wherein the sleeve includes a first aperture and a second aperture with the edge being staked to the first aperture, the sleeve-engaging portion further including a dimple configured to engage the second aperture.

13. A retention and reinforcement system for knobs or levers, comprising:

a chassis defining an aperture;

a sleeve extending from the chassis aperture;

a graspable member having an interior wall and being configured to engage the sleeve and having an axially-inner end;

a collar having a flanged portion and a sleeve engaging portion;

the collar being staked to the sleeve and sandwiched between the sleeve and the interior wall of the graspable member with the flanged portion disposed adjacent the chassis and the sleeve engaging portion disposed adjacent the sleeve.

* * * * *